US008578575B2

(12) United States Patent
Seifert et al.

(10) Patent No.: US 8,578,575 B2
(45) Date of Patent: Nov. 12, 2013

(54) DEVICE AND METHOD FOR PRODUCING A UD LAYER

(75) Inventors: Matthias Seifert, Lugau (DE); Frank Vettermann, Jahnsdorf (DE); Astrid Kirchberg, Chemnitz (DE); Matthias Thieme, Chemnitz (DE); Dietmar Reuchsel, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 205 days.

(21) Appl. No.: 12/951,686

(22) Filed: Nov. 22, 2010

(65) Prior Publication Data

US 2011/0154630 A1 Jun. 30, 2011

(30) Foreign Application Priority Data

Nov. 27, 2009 (DE) ..... 10 2009 056 189

(51) Int. Cl.
*D02J 1/18* (2006.01)
*D04H 3/04* (2012.01)

(52) U.S. Cl.
USPC ..... 28/282; 28/100

(58) Field of Classification Search
USPC ..... 28/282, 283, 100, 172.1, 172.2, 190, 28/192, 194, 185, 191; 19/66 T, 66 R, 157; 242/364.6, 364.7, 364.9, 417, 615.2
See application file for complete search history.

(56) References Cited

U.S. PATENT DOCUMENTS 2,491,438 A * 12/1949 Bodansky ..... 28/194
3,145,429 A * 8/1964 Resor ..... 19/157
3,277,537 A 10/1966 Roeder et al.
3,497,920 A 3/1970 Brownell
3,550,827 A * 12/1970 Timbie ..... 226/25
3,673,036 A * 6/1972 Lipe ..... 156/250
3,698,039 A * 10/1972 Kalwaites ..... 28/103
4,301,579 A 11/1981 van den Hoven
4,903,914 A * 2/1990 Seaborn et al. ..... 242/147 M
5,355,567 A * 10/1994 Holliday ..... 28/282
5,401,344 A * 3/1995 Dickson et al. ..... 156/90
5,588,194 A * 12/1996 Ulbrich et al. ..... 28/194
6,032,342 A 3/2000 Kawabe et al.

(Continued)

FOREIGN PATENT DOCUMENTS

BE 649 291 12/1964
DE 197 07 125 6/1998

(Continued)

OTHER PUBLICATIONS

Chinese Office Action conducted in counterpart Chinese Appln. No. 201010565648.5 (Dec. 5, 2012) (w/ English language translation).

(Continued)

*Primary Examiner* — Amy Vanatta

(74) *Attorney, Agent, or Firm* — Greenblum & Bernstein, P.L.C.

(57) ABSTRACT

Device and method for producing a unidirectional (UD) layer from a predetermined number of filament strands. Device includes a dispenser arrangement structured and arranged for delivering the predetermined number of filament strands, and a storage arrangement, structured and arranged for temporary storage of the predetermined number of filament strands. The storage arrangement includes separate storage parts for each of the predetermined number of filament strands. Device also includes a spreading arrangement and an outlet.

17 Claims, 6 Drawing Sheets

(56) References Cited

U.S. PATENT DOCUMENTS

| | | | | |
|---|---|---|---|---|
| 6,385,828 | B1 | 5/2002 | Kiss et al. | |
| 6,543,106 | B1 * | 4/2003 | Ames et al. | 28/283 |
| 6,585,842 | B1 | 7/2003 | Bompard | |
| 6,743,392 | B2 * | 6/2004 | Tanaka et al. | 264/444 |
| 7,571,524 | B2 | 8/2009 | Kawabe et al. | |
| 7,832,068 | B2 | 11/2010 | Kawabe et al. | |
| 2002/0123819 | A1 | 9/2002 | Baudry et al. | |
| 2003/0148082 | A1 * | 8/2003 | Bompard et al. | 428/292.1 |
| 2003/0172506 | A1 * | 9/2003 | Guirman et al. | 28/282 |
| 2006/0137156 | A1 | 6/2006 | Kawabe et al. | |
| 2006/0225465 | A1 | 10/2006 | Kinder et al. | |
| 2008/0223505 | A1 | 9/2008 | Bompard | |
| 2009/0271960 | A1 | 11/2009 | Kawabe et al. | |

FOREIGN PATENT DOCUMENTS

| | | |
|---|---|---|
| DE | 10312534 | 8/2004 |
| DE | 698 19 699 | 10/2004 |
| DE | 100 03 184 | 6/2006 |
| DE | 10 2005 008 7 | 9/2006 |
| DE | 10 2005 052 6 | 4/2007 |
| DE | 603 05 544 | 5/2007 |
| EP | 0 837 162 | 4/1998 |
| GB | 1 209 803 | 10/1970 |
| JP | 2006-070370 | 3/2006 |
| JP | 2007-518890 | 7/2007 |
| JP | 2007-276193 | 10/2007 |
| WO | 98/44183 | 10/1998 |

OTHER PUBLICATIONS

German Office Action conducted in German Appln. No. 10 2009 056 189.7 (Jan. 30, 2013) (w/ English language translation).

European Office action conducted in counerpart European Patent application No. 10 00 8359 (Jun. 6, 2012) [w/ partial English language translation].

Japan Office action, dated Aug. 14, 2012 along with an english translation thereof.

Chinese Office action conducted in counerpart Chinese Patent application No. 201010565648.5 (Dec. 23, 2011) [with English language translation].

English language translation of Japanese Office action conducted in counterpart Japanese Appln. No. 2010-245548, (Mar. 5, 2013).

* cited by examiner

DEVICE AND METHOD FOR PRODUCING A UD LAYER

CROSS-REFERENCE TO RELATED APPLICATIONS

The present application claims priority under 35 U.S.C. §119 of German Patent Application No. 10 2009 056 189.7, filed on Nov. 27, 2009, the disclosure of which is expressly incorporated by reference herein in its entirety.

BACKGROUND OF THE INVENTION

1. Field of the Invention

The embodiments of the invention relate to a device for producing a unidirectional (UD) layer from a predetermined number of filament strands with a dispenser arrangement for delivering the filament strands, a storage arrangement for temporary storage of the filament strands, a spreading arrangement and an outlet.

Furthermore, the embodiments of the invention relate to a method for producing a UD layer from a predetermined number of filament strands, which are drawn off from a dispenser arrangement, in which the filament strands are spread apart to form bands. The filament strands are guided through a storage arrangement between the pull-off and the spreading and to an outlet after the spreading.

2. Discussion of Background Information

A device of this type and a method of this type are known, for example from DE 698 19 699 T2.

DE 10 2005 008 705 B3 shows a device for feeding bands to a knitting machine, in which bands are drawn off from bobbins at a uniform speed, but are further processed with predetermined stoppage times. During the stoppage times the bands are temporarily stored in a controlled store.

From DE 10 2005 052 660 B3 a device and a method are known for spreading a carbon fiber strand. In order to be better able to spread out the fiber strand, it is heated in that an electric current is conducted through.

DE 197 07 125 A1 describes a method for producing unidirectional scrims, in which the spread-out fibers are connected to one another by transverse connecting threads in order to form a web.

In the production of fiber-reinforced plastics, the aim is to give these plastics a certain tensile strength. This tensile strength is caused by the reinforcing fibers. The tensile strength is greatest in the direction in which the reinforcing fibers run. Accordingly, it is advantageous to align the reinforcing fibers of a layer all in one direction. A layer of this type is then referred to as a "unidirectional layer" or a "UD layer." In a UD layer, a plurality of fibers or filaments lies virtually parallel next to one another in one direction. UD layers of this type are used to produce a monoaxial, biaxial or multiaxial scrim. In a multiaxial scrim, several UD layers of this type with different directions are laid on top of one another and connected to one another.

The fibers or filaments that are required in order to reinforce the fiber-reinforced plastic are present in the form of filament strands or filament bundles. In the case of carbon filaments, a filament strand of this type often contains several thousand individual filaments. It is customary for strands to contain 12,000, 24,000, 50,000 or even 480,000 fibers or filaments. It must be possible to handle the filaments of a filament strand together.

The filament strands are wound on bobbins, for example. Before processing, the filament strands then must be drawn off from the bobbins. Although it can be assumed that the filament strands are all wound onto the bobbins with approximately the same tension, local differences arise that lead to corresponding local changes in the filament strands. When the individual filament strands are then spread out to form bands and arranged next to one another, the problem often arises that the UD layer thus produced does not lie flat but warping occurs, which makes a later processability difficult. For example, it is then more difficult to drape a cut-to-length UD layer in a mold before a plastic matrix is poured in.

In the method known from DE 698 19 699 T2 or DE 197 07 125 A1, the bands are provided with a transverse cohesion after the filament strands have been spread, so that a UD layer cohesive in the transverse direction is produced. This layer is then wound onto a beam. To produce a multiaxial scrim, this UD layer can then be drawn off from the beam and processed. The aim is to minimize the effects of the differences of the bands by means of the transverse cohesion.

A scrim that has been provided with a cohesion in the transverse direction, however, has certain disadvantages in further processing. In extreme cases, a UD layer with transverse cohesion can be deformed in only one direction, namely such that the filaments are bent. Due to the transverse cohesion a displacement of the filaments in the longitudinal direction relative to one another is virtually no longer possible or no longer possible to a satisfactory extent.

SUMMARY OF THE INVENTION

Embodiments of the invention are direction to producing a UD layer with good processability.

According to the embodiments, a device of the type mentioned at the outset in which the storage arrangement for each filament strand has a separate storage unit.

This takes into consideration the fact that, although the filament strands on average all have the same elongation and thus the same local length, local deviations can occur. These deviations can now be balanced by the storage device. Thus, differences in length average out over time. It is thus possible to wind up on the beam the bands lying next to one another as a UD layer without transverse cohesion and nevertheless to ensure that the individual bands have the same length. The same length can be achieved simply by adjusting the same tension. This tension is defined among other things by a tensile force prevailing in the storage or storage parts.

Preferably, the storage or storage parts for adjacent filament strands are arranged offset relative to one another. Thus, there is sufficient space available for each storage part. When the storage part, for example, has a roller over which the filament strand is guided, this roller can be sufficiently supported, for example, attached to a lever arm, so that this roller can change its position in order to provide a changeable storage path. The roller can also be supported in a linear guide. In both cases, the roller (or a different deflection device) can be acted on with a predetermined clamping force in order to introduce a specific tensile force into the filament strand. This can be the weight of the roller or also an additional force, for example, a spring. Sufficient space is available for all of the elements of the storage means due to the offset arrangement of adjacent storage means.

Preferably, the storage arrangement has at least one error sensor. An error sensor can thereby be provided for all of the storage means jointly. An error sensor can also be provided for each storage or storage part or one error sensor respectively is used for a group of storage parts. Since the bands theoretically are all similar to one another and only local differences are to be expected, it is to be assumed that during the production of the UD layer the storage parts for the individual filament strands, although they are filled differently, i.e., the fill factor of the individual storage parts as a rule differ from one another, it is not to be assumed that a storage part will overflow or run idle. If this occurs, it is discovered by the error sensor, and the device can be stopped and an error signal emitted. An operator can then investigate the situation and, if necessary, make a correction.

Preferably, feeder rolls are arranged between the dispenser arrangement and the storage arrangement. The feeder rolls draw the filament strands out of the dispenser arrangement and guides them to the storage arrangement. Thus, the storage arrangement is not loaded with the forces that are necessary to draw off the filament strands from the dispenser arrangement.

Preferably, a filament strand drive arrangement is arranged behind the spreading arrangement in the direction of feed. The filament strand drive arrangement can be formed, for example, by a second group of feeder rolls. This filament strand drive arrangement ensures that the forces that are necessary for spreading the filament strands to form bands are uncoupled from the forces prevailing at the outlet. Thus, it is possible to spread the filament strands with a tensile stress which is, for example, much higher than the tensile stress with which the UD layer is wound up.

Preferably, the spreading arrangement has several spreader devices, which are arranged at different positions, wherein adjacent filament strands run through different spreader devices. It is thus possible to spread the individual filaments strands beyond a width that corresponds to a dividing width. The dividing width results from the width of the UD layer divided by the number of filament strands used. It can be observed that through the spreading of the filament strands to form bands, in many cases a thickness distribution in the band develops which is not constant. In fact, this thickness distribution follows the form of a bell curve. When the filament strands are enlarged beyond the dividing width, the thickness of the UD layer can be formed in a uniform manner to a greater degree than hitherto, for example, in that the bands are allowed to overlap one another in the transverse direction. In this case, two thinner edge sections are laid one on top of the other, so that approximately the thickness of the bands at their center is produced through the sum of the thickness of the edge sections. Although an absolutely constant thickness is not achieved thereby, the thickness is much more uniform.

It is preferable that a calibration device is arranged downstream of the spreading arrangement to form a width reduction device for each filament strand. The calibration device pushes the bands, that is, the spread-out filament strands, back together somewhat transversely to the direction of feed. The calibration device thereby acts mainly on the filaments that are arranged in the edge regions. The center of the bands remains largely unchanged due to the calibration device. When filaments are pushed together somewhat at the edges, an increase in thickness is produced here, which is desirable in order to shape the thickness of the band in a uniform manner again. With the use of the calibration device, it is often possible to manage without an overlapping of the bands. The bands then do not have any transverse cohesion among one another so that a good deformability of the UD layer in several directions is ensured.

Preferably, the calibration device has a band width variation device. When the bands are pushed together transversely to their direction of feed, sections of the bands can be produced thereby which have a larger width and sections that have a smaller width. When the individual bands are then arranged next to one another, gaps are produced in the fabric formed thereby, through which plastic can later penetrate. This makes it easier to realize a penetration of the scrim with plastic. The band width variation device can be formed in different ways. When the calibration device has a rotating shaft with grooves, which ultimately define the width of the bands, then the width of the bands can be easily changed by using grooves that have a changing width in the circumferential direction. In this case, the width of the bands produced in this manner varies periodically. Another possibility is to form the calibration device by shoulder rings located on a shaft, between which shoulder rings the bands are guided through. Through a change of the axial position of the shoulder rings, a change in the width of the bands can be produced. The width change of adjacent bands can be coordinated with one another such that the bands abut against one another with their larger widths when they are arranged next to one another, so that larger gaps are formed in the regions with a smaller width.

Preferably, a dividing device is arranged before the spreading arrangement, which dividing device has at least one guide body with a groove for each filament strand. The position of the band is determined by means of the groove. The individual bands can thus be positioned with a relatively high precision where they will be later required in the UD layer. This also applies when the bands are drawn off from bobbins with a cross-winding form.

Preferably, the filament strand drive arrangement has a nip in which the spread-out filament strands are acted on with a pressure. The nip, which can also be referred to as a roller gap, is formed, for example, by a tension roller and a counter-element. The tension roller ensures that the bands can be carried along in the filament strand drive arrangement free from slippage, so that they can be fed to the outlet, for example, of a take-up mechanism, with defined tensile stress conditions.

According to embodiments of the invention, a method of the type referenced at the outset includes storing each filament strand individually in the storage arrangement. As explained above in connection with the device, it is possible in this manner to balance the locally occurring differences in length in the bands by the individual storage or storage parts, so that the UD layer can be produced from bands that also have the same length locally. This is based on the idea that the filament strands wound up on the bobbins in principle have the same properties. However, differences can occur through the wound-up length of an individual bobbin, which can be balanced through the individual temporary storage of the individual filament strands.

Preferably, the filament strands are drawn off from the dispenser arrangement with the aid of feeder rolls and guided to the storage arrangement. The forces that are necessary to draw off the filament strands from the dispenser arrangement can thus be uncoupled from the forces in the storage arrangement.

Preferably, a tension with which the filament strands are spread apart is uncoupled from a tension at the outlet. It is thus possible to spread apart the filament strands with a relatively high tension so that very thin bands can be produced.

Preferably, the filament strands are spread apart over a dividing width to form bands, wherein the dividing width corresponds to the width of the UD layer divided by the number of filament strands. The usual spreading of the filament strands is carried out in that the filament strands are drawn over a rod with a relatively small diameter. In many cases two or more rods are also used. The filament strand is then acted on with a certain tensile stress. The filaments of the filament strand that are further distant from the rod, then try to approach the rod, wherein they try to displace the filaments between them and the rod. In the center of the filament strands this displacement cannot be performed so well as in the edge regions. Accordingly, a somewhat larger thickness remains in the center of the filament strands. In contrast, the edge regions are thinner, so that the thickness distribution approximately follows the form of a bell curve. When the filament strands are enlarged beyond the dividing width, there are more possibilities for embodying the thickness of the UD layer in a somewhat more uniform manner. One possibility is to allow adjacent bands to overlap one another. In this case, approximately the thickness in the middle of the bands results from the sum of the thinner edge areas. Although an absolute uniformity of the thickness will be impossible to achieve thereby, the thickness will be much more uniform than before.

Another possibility is to push the bands together laterally after spreading. Only the filaments in the edge regions are impinged by the pushing together. In contrast, the filaments in the center of the bands normally remain unaffected by the pushing together. Therefore only the thickness of the bands in the edge regions is increased by the pushing together. In the center it remains unchanged.

Preferably, bands with a changing width are produced by the pushing together. As stated above in connection with the device, it can be ensured in this manner during the assembly of the bands to form a fabric that gaps are produced between adjacent bands, through which later a plastic can penetrate in order to form a fiber-reinforced plastic part. The width change can be carried out, for example, periodically. Adjacent bands can then be arranged next to one another such that they abut against one another with their larger widths so that a gap remains in the fabric in the regions with a smaller width.

Embodiments of the invention are directed to a device for producing a unidirectional (UD) layer from a predetermined number of filament strands. The device includes a dispenser arrangement structured and arranged for delivering the predetermined number of filament strands, and a storage arrangement, structured and arranged for temporary storage of the predetermined number of filament strands. The storage arrangement includes separate storage parts for each of the predetermined number of filament strands. The device also includes a spreading arrangement and an outlet.

In accordance with embodiments of the present invention, the storage parts of adjacent filament strands may be arranged offset relative to one another.

According to other embodiments of the invention, the storage arrangement may include at least one error sensor.

In accordance with other embodiments, feeder rolls can be arranged between the dispenser arrangement and the storage arrangement.

Moreover, a filament strand drive arrangement may be arranged after the spreading arrangement relative to a feed direction. The filament strand drive arrangement can include a nip structured and arranged to apply pressure on the spread-out filament strands.

According to still other embodiments of the instant invention, the spreading arrangement can include a plurality of spreader devices located at different positions. Further, adjacent filament strands may be guided through different spreader devices. The spreader can form a plurality of bands from the plurality of filament strands. Also, a calibration device can be arranged after the spreading arrangement relative to a feed direction that is structured as a width reduction device for each band. The calibration device may include a band width variation device.

According to further embodiments, a dividing device can be arranged before the spreading arrangement relative to a feed direction and may include at least one guide body with a groove for each filament strand.

According to further embodiments, the method can further include a winding device structured and arranged to wind up the UD layer. Further, a separating material supply can be arranged to feed a separating material between wound UD layers.

Embodiments of the invention are directed to a method for producing a unidirectional (UD) layer from a predetermined number of filament strands. The method includes drawing off the predetermined number of filament strands from a dispenser arrangement, guiding the predetermined number of filament strands through a storage arrangement having individual storage parts for each filament strand, spreading apart the filament strands to form bands, and guiding the bands through an outlet. The storage arrangement is arranged between drawing off and the spreading.

According to embodiments of the instant invention, the filament strands may be drawn off from the dispenser arrangement with the aid of feeder rolls and guided to the storage arrangement.

In accordance with other embodiments, a tension can be applied to the filament strands during the spreading apart.

According to still other embodiments, a tension on the filament strands during the spread apart can be uncoupled from a tension on at the outlet.

Further, the filament strands can be spread apart to form bands having a dividing width corresponding to a width of the UD layer divided by the predetermined number of filament strands.

In accordance with still other embodiments of the present invention, after the spreading, the method can further laterally pushing the bands together. The pushing together of bands can change the band width.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
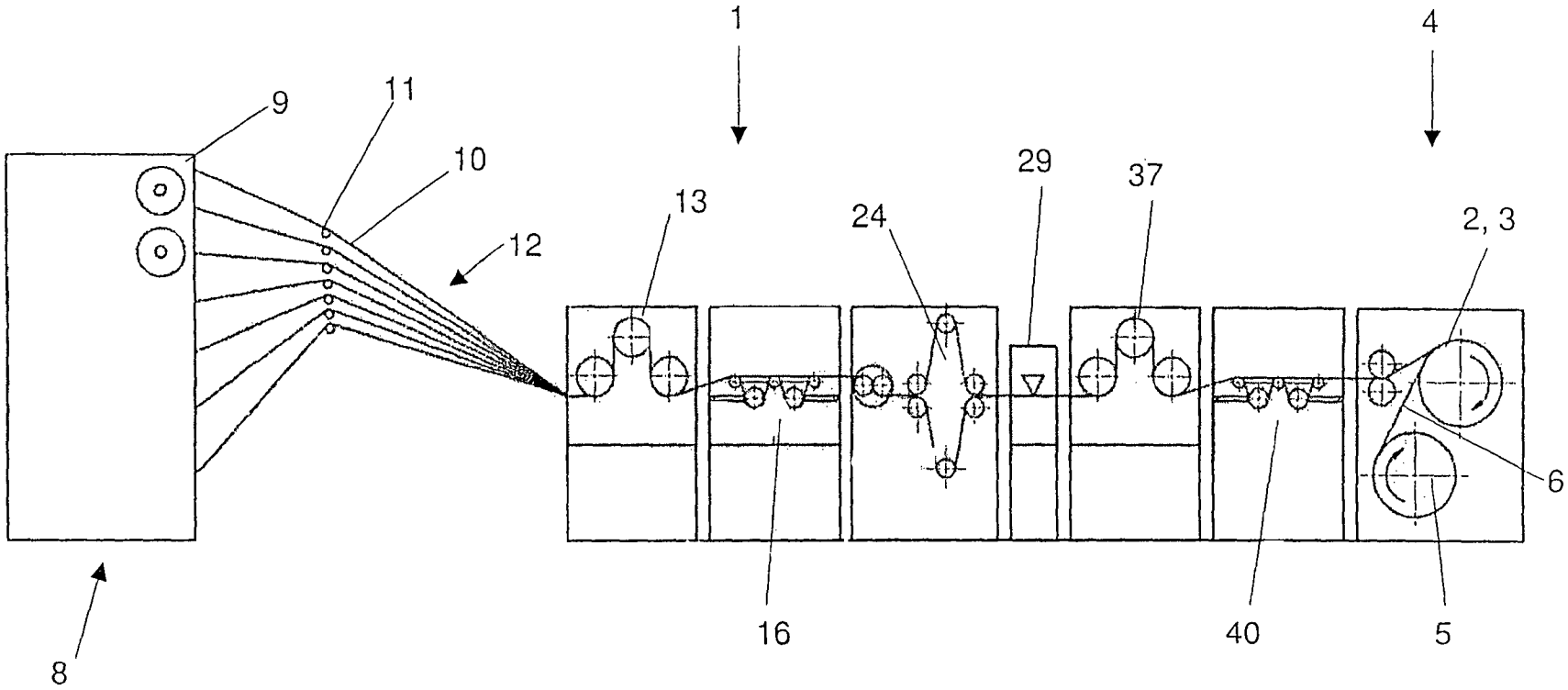
FIG. 1 diagrammatically illustrate an overall view of the device for producing a UD layer.
Figure 5:
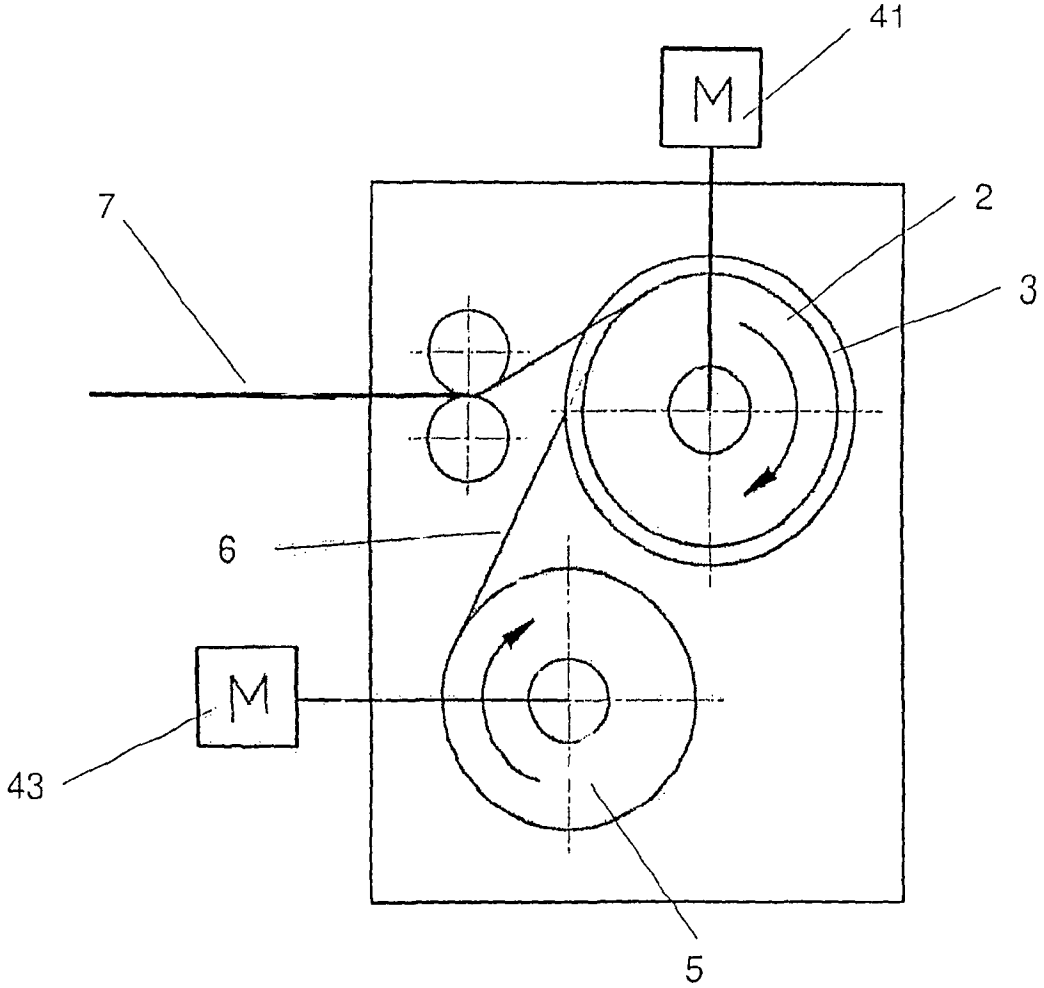
FIG. 5 illustrates an enlarged representation of a winding-up device depicted in FIG. 1.

FIG. 1 shows a device 1 for producing a UD layer, which is wound up on a beam 2. Beam 2 has side disks 3 and is arranged in a bobbin carriage 4. A supply bobbin 5 is located in bobbin carriage 4, from which a separating material 6 is drawn off. Separating material 6 is, for example, a paper or a film of plastic or a woven fabric or any other fabric, which is jointly wound up with UD layer 7 during the winding up of UD layer 7 (FIG. 5), so that separating material 6 separates from one another two consecutive windings of the lap wound up on beam 2.

Several bobbins 9 are arranged in a creel 8, which here forms a dispenser arrangement, from which bobbins respectively one filament strand 10 is drawn off tangentially. Filament strands 10 are wound up on bobbins 9 in a cross bobbin winding form. The tangential pull-off from rotating bobbin 9 means that a twist being inserted into filament strand 10 is avoided. To achieve a specific tension in filament strand 10, bobbin 9 is braked. The aim thereby is that the band tension achieved should be as uniform as possible as well as constant over the entire bobbin pull-off. When filaments and filament strands are referred to here, this should also mean fibers and fiber strands.

Creel 8 has at its outlet guide elements 11, which prevent filament strand 10 from causing a lateral movement, which could be caused by the cross bobbin structure. These guide elements 11 are composed, for example, of shoulder rings at deflection points. When particularly high demands are made on the running quality and the lateral displacement should be further minimized, band swivel devices (not shown) are considered. These band swivel devices deflect filament strand 10, which is unwound from bobbin 9 in a traversing and horizontal manner, into the vertical. The lateral displacement is thereby converted into a rotation about the longitudinal axis of filament strand 10.

Instead of the creel, another dispensing arrangement can also be used, as long as it is ensured that filament strands 10 can be drawn off untwisted.

Creel 8 is followed by a transitional region 12, which bridges a spacing from first feeder rolls 13. The plurality of filament strands 10 thereby run almost parallel and with a distribution transverse to the direction of feed, which essentially corresponds to the width of finished UD layer 7. Filament strands 10 are therefore already distributed uniformly over this width.

Through the free length in transitional region 12, in which filament strands 10 are not supported, it is possible that with the occurrence of a false twist, which could occur at the pull-off from bobbins 9, this twist is held back for so long that it can be undone by another twist in the opposite direction.

Figure 2:
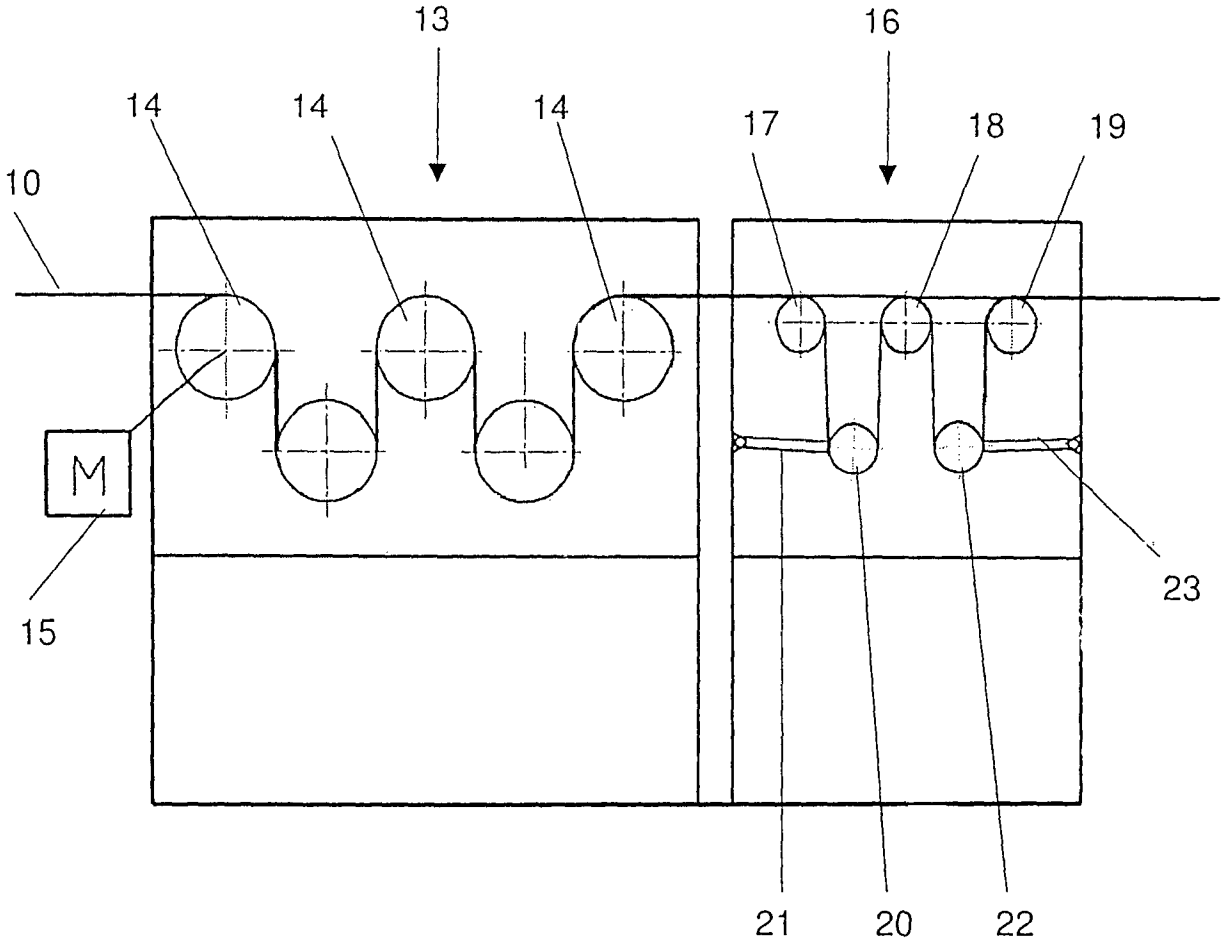
FIG. 2 illustrate an enlarged partial representation with first feeder rolls and a storage device depicted in FIG. 1.

In first feeder rolls 13 (FIG. 2), each filament strand 10 is guided free from slippage over several driving rollers 14. The freedom from slippage results from a sufficiently large angle of wrap around driving rollers 14. Driving rollers 14 have the same circumferential speed. This is achieved in a simple manner in that they all have the same diameter and identical rotational speeds. To this end they are driven for the sake of simplicity by a common servo motor 15. All filament strands 10 are transported at the same speed. All filament strands 10 thereby lie parallel in one plane.

First feeder rolls 13 are followed by a storage arrangement 16, which has a separate storage path for each filament strand 10. To this end, storage arrangement 16 has three cylinders 17-19. More cylinders 17-19 can also be provided. Arriving filament strands 10 are then guided downwards alternately in the transverse direction via first cylinder 17 in the direction of feed or via second cylinder 18 in the direction of feed. One filament strand 10, which is guided downwards over cylinder 17, is deflected upwards again over a roller 20, wherein the roller 20 is arranged on a pivotable lever 21. Corresponding filament strand 10 is deflected over second cylinder 18 in the direction of feed again. Adjacent filament strand 10 is deflected downwards over second cylinder 18, then guided over a roller 22, which is attached to a pivotable lever 23, and deflected in the direction of feed over third cylinder 19 in the direction of feed again. Accordingly, a separate roller 20, 22 is assigned to each filament strand 10. Rollers 20, 22, form a storage path with changeable length and act on corresponding filament strand 10 with a tensile force through their own mass or also through other suitable manner, such as a spring, an operating cylinder or the like. A tension is thus produced in filament strand 10. Each filament strand 10 is thereby acted on individually. The sheet of filament strands 10 is thereby divided into two groups or planes. When the passage of all of filament strands 10 through device 1 runs free from malfunctions or within low tolerance limits, then all rollers 20, 22 are located approximately in the same position. When one or more rollers 20, 22 adopt a clearly deviating position, then there is an undesirable deviation in the sheet of filament strands 10. By determining these roller positions with the aid of error sensors (not shown) (a common error sensor can also be provided), conclusions can be drawn about the causes of the deviation and counter measures can be initiated.

Storage arrangement 16 is followed by a dividing device 24. Dividing device 24 has two guide rods 25, which have two functions. Guide rods 25 have several ribs, so that grooves are formed in which respectively one filament strand 10 is guided. The term "groove" is here intended to be understood in general as a geometric form that has two lateral limiting walls. Through the arrangement of the grooves, a predetermined position results for each filament strand 10 in the width direction. Furthermore, the ribs, that is, the lateral walls of the grooves, also determine how far each filament strand 10 can spread here. The weight per unit area of a band 26 is defined thereby, which is later formed from filament strand 10. The wider the corresponding filament strand 10 can spread, the smaller the weight per unit area of band 26. The weight per unit area of band 26 corresponds to the weight per unit area of UD layer 7. Bands 10 are expediently guided in an S-shape over two or more guide rods 25. Since this guidance is already carried out under a certain tension, a slight spreading effect is hereby already started here.

Dividing device 24 is followed by a spreading device 27. Several guide rods 28*a*, 28*b* are arranged in the spreading device, over which guide rods the sheet of filament strands 10 is drawn. Through the deflection over guide rods 28*a*, 28*b* at a predetermined angle, for example, 180°, an increase in the tension in individual filament strands 10 occurs and in connection with the deflection a spreading of filament strands 10 occurs. Filament strands 10 are spread out thereby. The angle of wrap around the guide rods 28 is adjustable. The values for the tension in filament strands 10, processing speed and angle of wrap are selected correctly when after spreading arrangement 27 the widths of bands 26 then formed correspond to a predetermined value.

Figure 6:
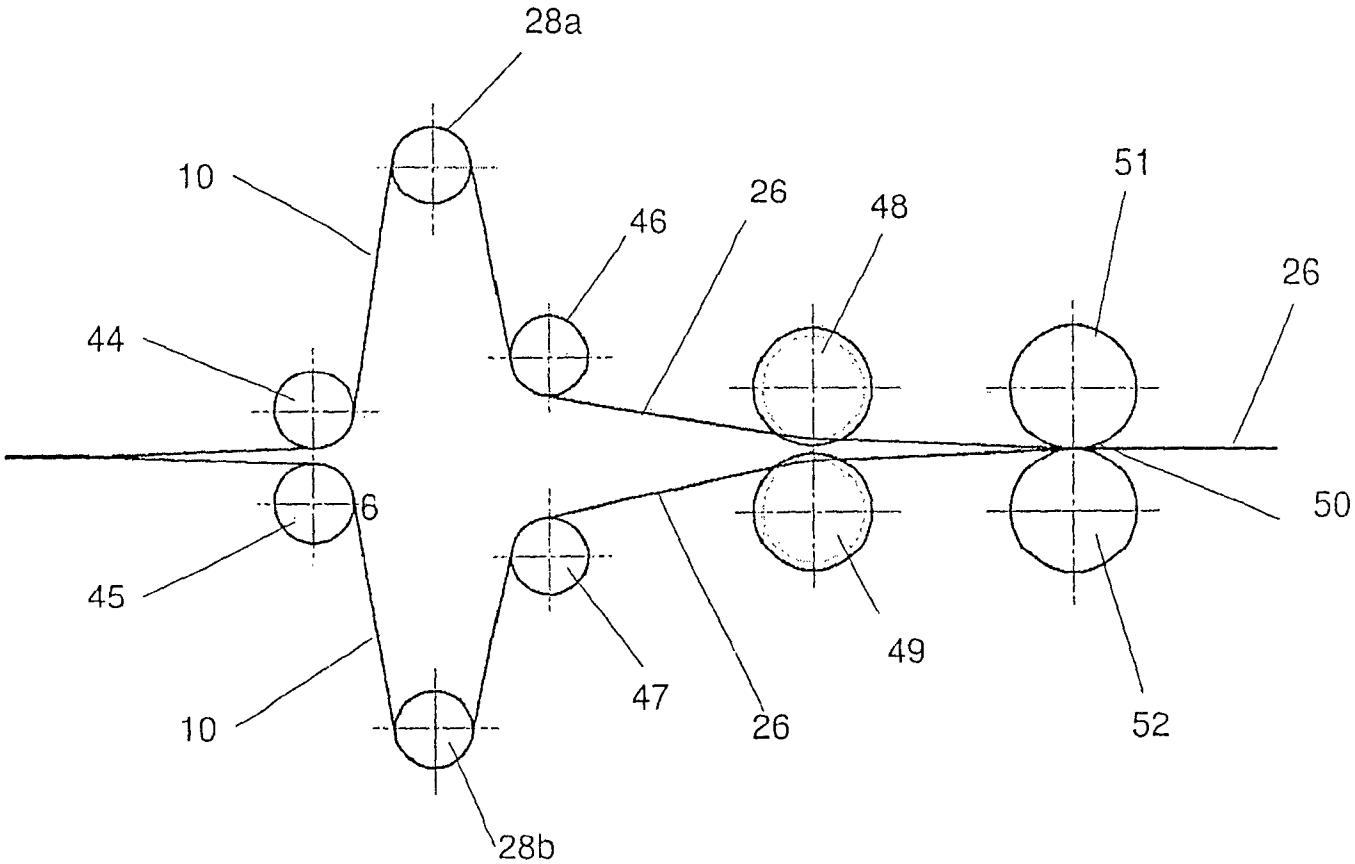
FIG. 6 diagrammatically illustrates a spreading device depicted in FIG. 1.

FIG. 6 shows spreading arrangement 27 somewhat more clearly in a diagrammatic representation. It is discernible that two guide rods 28*a*, 28*b* are provided, which are arranged at different positions. Adjacent filament strands 10 are alternately guided over these guide rods 28*a*, 28*b*. If filament strands 10 were numbered in the transverse direction, for example, filament strands 10 with an odd ordinal number are guided over guide rods 28*a* and the filament strands with an even ordinal number are guided over guide rods 28*b*. Auxiliary rollers 44-47 guarantee the course of filament strands 10.

Because adjacent filament strands 10 are guided over different spreading devices 28*a*, 28*b* in spreading arrangement 27, which spreading devices are spatially distant from one another, adjacent filament strands 10 do not impede one another during spreading. They can therefore be spread beyond a dividing width, i.e., over the width of UD layer 7 divided by the number of filament strands 10.

With a spreading of this type, bands 26 are produced, which have a thickness course in the transverse direction, which has approximately the shape of a bell curve. In other words, bands 26 are somewhat thicker in their center than in their edge regions. When a UD layer 7 is assembled from bands 26 of this type, UD layer 7 has a corresponding waviness.

In order to remedy this problem, adjacent bands 26 that have been spread beyond the division width can be arranged in an overlapping manner. In this case, an addition of the thicknesses of the edge regions occurs in the overlapping region, which addition, with corresponding adjustment, corresponds approximately to the thickness in the center of bands 26.

Another preferred embodiment, however, lies in guiding bands 26 through respectively one calibration device 48, 49. Calibration device 48, 49, for example, has one groove for each band 26, which groove ultimately defines the width of band 26, which has been guided through the groove. Since band 26 was previously wider than the groove, band 26 is compressed somewhat laterally in the groove, i.e., calibration device 48, 49 forms a width reduction device. The width of bands 26 can then be adjusted exactly to the dividing width, so that after the assembly of bands 26 in a nip 50, which is formed by two rollers 51, 52, a fabric is formed in which gaps are no longer present. However, the width of bands 26 can also be adjusted to be somewhat smaller than the dividing width, so that gaps are produced between adjacent bands 26, which have a width of 0.1 to 0.5 mm, for example.

The grooves of calibration devices 48, 49 are arranged offset with respect to one another in the transverse direction, namely by the width of respectively one groove, so that bands 26 can later be combined to form UD layer 7 without a further deflection in the transverse direction.

When the grooves of calibration devices 48, 49 are provided with a changing width in the circumferential direction, bands 26 are also produced with a width that changes continuously and periodically in the direction of feed. When bands 26 are later combined to form a fabric, then gaps or recesses are formed between adjacent bands 26 in the regions of the bands that have a smaller width, through which gaps or recesses a plastic can later penetrate when a fiber-reinforced plastic element is produced. Alternatively to this, calibration devices 48, 49 can also be used in which bands 26 are guided between shoulder rings, the axial position of which is changeable. When the shoulder rings are pushed closer together, band regions are formed with a smaller width. When the shoulder rings are moved further apart, band regions are produced with a greater thickness. In every case the width variation is relatively slight. It is sufficient if the band width is changed by a few percent, for example, 3.5% or 10%.

No transverse cohesion that goes beyond a transverse cohesion of fibers in a filament strand 10 or band 26 is produced between adjacent bands 26. The filaments are usually coated with a sizing agent, which can lead to an adhesion of the individual filaments to one another during a heating, such as is produced, for example, by friction during deflection. However, this adhesion is so weak that it is not possible to use the sizing agent of bands 26 thus slightly heated for a transverse cohesion between bands 26. Individual bands 26 can thus still be separated from one another easily.

Figure 3:
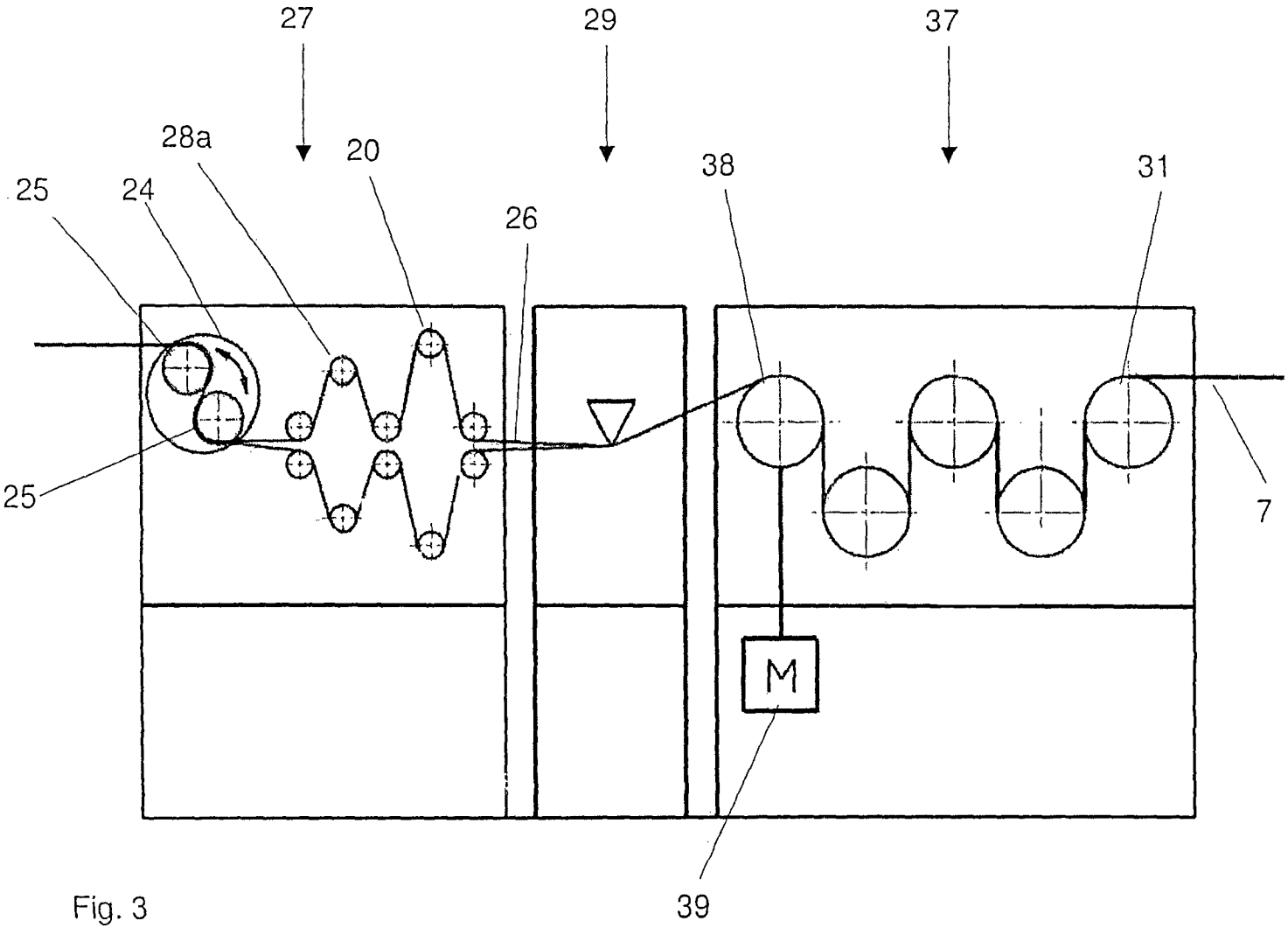
FIG. 3 illustrates an enlarged partial representation with a spreading device and second feeder rolls depicted in FIG. 1.

In FIG. 3, several bands 26 are discernible next to one another without gaps at the outlet of spreading arrangement 27, so that the impression of a fabric is produced.

Figure 4:
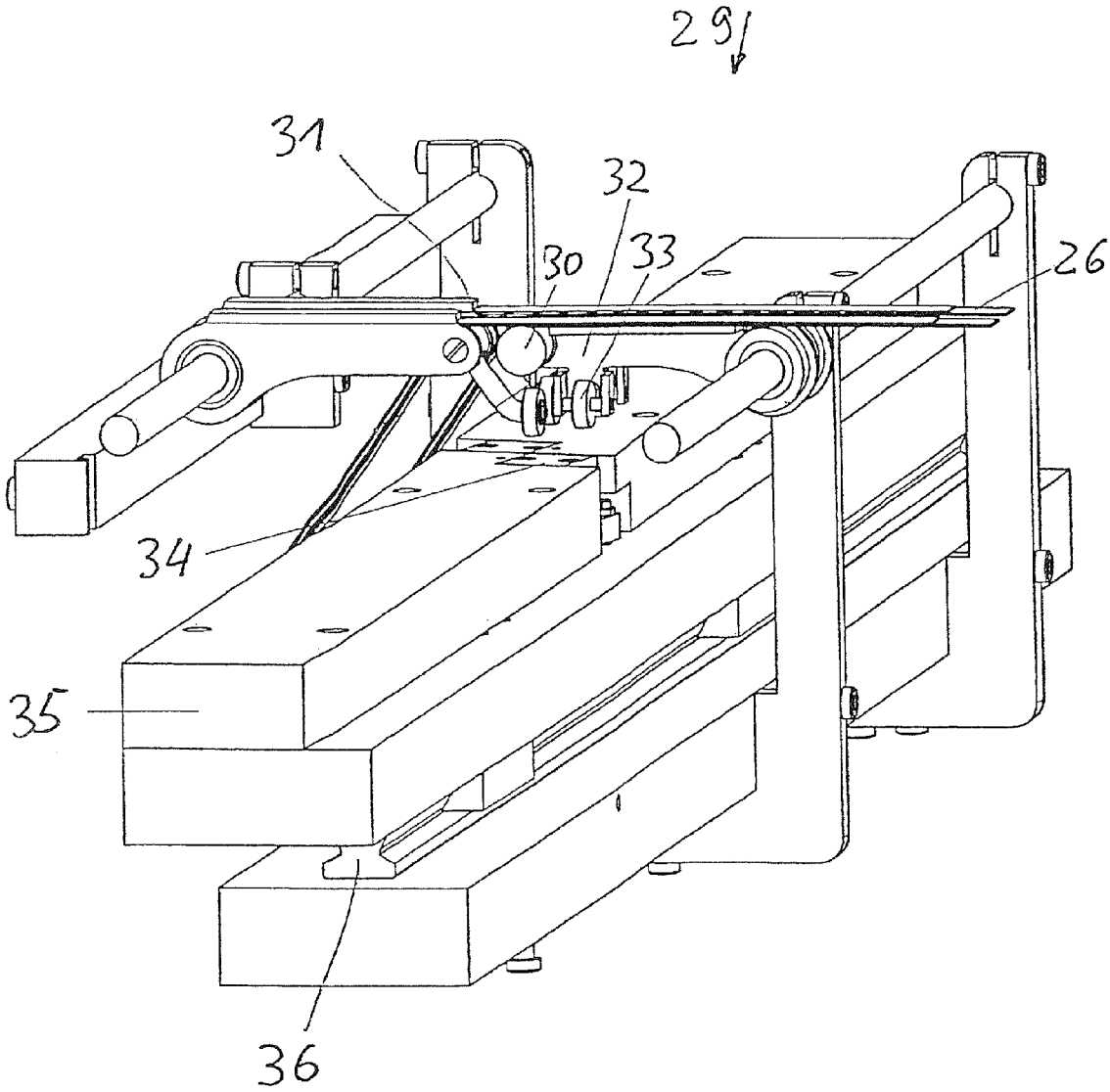
FIG. 4 illustrates an enlarged representation of a tension measurement device depicted in FIG. 1.

A tension measuring device 29 is arranged behind spreading arrangement 27 in the direction of feed, which tension measuring device detects the tension of individual bands 26 individually. Tension measuring device 29 is shown enlarged in FIG. 4. It is discernible here that individual bands 26 are guided respectively individually over a measuring cylinder 30, 31. Since bands 26 have already achieved their final thickness in this region, that is, they form a closed surface, it is necessary to separate the bands 26 into two planes so that each band can be measured individually. Since there is no transverse cohesion between two adjacent bands 26, a separation of this type is easily possible.

Measuring cylinder 30 is attached to a lever 32, which is supported with a roller 33 on a measuring sensor 34. Measuring sensor 34 can be a piezo sensor. However, it can also operate according to a different principle. Measuring cylinders 31 of the other group are supported on levers in a corresponding manner, which levers are supported via rollers on a measuring sensor 34.

In order to keep the expenditure in terms of equipment low, a single measuring sensor can be used for each group of measuring cylinders 30, 31, which measures the individual band tensions sequentially, for example, at intervals of respectively one second. To this end, measuring sensor 34 is arranged on a carrier 35, which can be displaced on a rail 36 transversely to the direction of feed of bands 26 and can be moved under the levers to and fro in a traversing manner.

Through the measurement of the band tension in each individual band it is possible to detect friction value anomalies, which can occur, for example, due to soiling, and to correct them by a change of the band tension of the storage arrangement 16 before the spreading. When they exit from the tension measuring device 29, bands 26 are combined again to form a closed surface.

The tension measuring device 29 is followed by second feeder rolls 37 as a filament strand drive arrangement. Second feeder rolls 37 have several rollers 38, over which bands 26 are guided free from slippage. Rollers 38 have the same circumferential speed. Expediently, they have the same diameter and are driven by a servo motor 39 at the same rotational speed. A pressure roller can also be arranged on the last of rollers 38 in a manner not shown in further detail, so that a nip is produced, through which filament strands 10 spread out to form bands 26 are guided. It can be ensured thereby that bands 26 are guided through second feeder rolls 37 free from slippage.

Together with band storage arrangement 16, second feeder rolls 37 generate the tension necessary to spread out or expand filament strands 10 to form bands 26. This tension can be relatively high. Depending on the fibers used, the tension necessary to spread out or expand filament strands 10 to form bands 26 can be in the order of magnitude of 100 to 400 N.

The UD layer 7 should be stored with a much lower tension as a lap in bobbin carriage 4. Accordingly, second feeder rolls 37 can be used in order to achieve a decoupling between the tension that is used to spread out filament strands 10 and the winding tension.

In order to adjust the same defined tensile forces in all of bands 26, a band storage device 40 is provided, which is arranged between second feeder rolls 37 and bobbin carriage 4. Band storage device 40 can be designed exactly like storage arrangement 16. The adjustment of the tensile force on levers 21, 23 can deviate considerably from the values of storage arrangement 16, however. The level of the tension depends on the demands on the end product, that is, UD layer 7, and the material properties of filament strands 10.

In band storage device 40 it is again necessary to divide the closed surface of the bands 26 spread out in a parallel manner into two or more groups. Through the assembly of both groups of bands 26 after the passage through band storage device 40, the closed surface of UD layer 7 is reestablished, however.

After leaving band storage device 40, UD layer 7 with a closed surface without gaps and without transverse cohesion is formed again, as it were, automatically between individual bands 26. The transverse cohesion is at most as great as the transverse cohesion between filaments within a filament strand 10.

UD layer 7 is then wound up between side disks 3 of beam 2. The drive of beam 2 is carried out by a servo motor 41, which operates in combination with motors 15, 39 of the two sets of feeder rolls 13, 37. With increasing diameter on beam 2, the torque of servo motor 41 increases. However, the rotational speed can be reduced.

All of the filaments of the windings of the UD layer lying one on top of the other are parallel. In order to avoid these parallel filaments or fibers becoming interlocked in one another, separating material 6 is wound in between the individual windings during the winding up.

Separating material 6 is unwound from supply bobbin 5, which can be driven or braked by a servo drive 43. This ensures that the separating material 6 is also fed with a constant tensile force over the entire winding process.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for producing a unidirectional (UD) layer from a predetermined number of filament strands, comprising:

a dispenser arrangement structured and arranged for delivering the predetermined number of filament strands;

a storage arrangement, structured and arranged for temporary storage of the predetermined number of filament strands, comprising separate storage parts for each of the predetermined number of filament strands;

a spreading arrangement;

feeder rolls arranged between the dispenser arrangement and the storage arrangement;

a filament strand drive arrangement arranged after the spreading arrangement relative to a feed direction; and an outlet.

2. The device in accordance with claim 1, wherein the storage parts of adjacent filament strands are arranged offset relative to one another.

3. The device in accordance with claim 1, wherein the storage arrangement comprises at least one error sensor.

4. The device in accordance with claim 1, wherein the filament strand drive arrangement comprises a nip structured and arranged to apply pressure on the spread-out filament strands.

5. The device in accordance with claim 1, wherein the spreading arrangement comprises a plurality of spreader devices located at different positions, wherein adjacent filament strands are guided through different spreader devices.

6. The device in accordance with claim 5, wherein the spreading arrangement forms a plurality of bands from the plurality of filament strands.

7. The device in accordance with claim 6, further comprising a calibration device arranged after the spreading arrangement relative to a feed direction that is structured as a width reduction device for each band.

8. The device in accordance with claim 7, wherein the calibration device comprises a band width variation device.

9. The device in accordance with claim 1, further comprising a dividing device arranged before the spreading arrangement relative to a feed direction that comprises at least one guide body with a groove for each filament strand.

10. The device in accordance with claim 1, further comprising a winding device structured and arranged to wind up the UD layer.

11. The device in accordance with claim 10, further comprising a separating material supply arranged to feed a separating material between wound UD layers.

12. A method for producing a unidirectional (UD) layer from a predetermined number of filament strands, the method comprising:

drawing off the predetermined number of filament strands from a dispenser arrangement;

guiding the predetermined number of filament strands through a storage arrangement having individual storage parts for each filament strand;

spreading apart the filament strands to form bands;

guiding the bands through an outlet, wherein the storage arrangement is arranged between drawing off and the spreading and the filament strands are drawn off from the dispenser arrangement with the aid of feeder rolls and guided to the storage arrangement, and wherein a filament strand drive arrangement is arranged after the spreading arrangement relative to a feed direction.

13. The method in accordance with claim 12, wherein a tension is applied to the filament strands during the spreading apart.

14. The method in accordance with claim 12, wherein a tension on the filament strands during the spreading apart is uncoupled from a tension on the bands at the outlet.

15. The method in accordance with claim 12, wherein the filament strands are spread apart to form bands having a dividing width corresponding to a width of the UD layer divided by the predetermined number of filament strands.

16. The method in accordance with claim 12, wherein, after the spreading, the method further comprises laterally pushing the bands together.

17. The method in accordance with claim 16, wherein the pushing together of bands changes the band width.

* * * * *